US005531861A

United States Patent [19]

Yu et al.

[11] Patent Number: 5,531,861

[45] Date of Patent: Jul. 2, 1996

[54] CHEMICAL-MECHANICAL-POLISHING PAD CLEANING PROCESS FOR USE DURING THE FABRICATION OF SEMICONDUCTOR DEVICES

[75] Inventors: Chris C. Yu, Irvine, Calif.; Tat-Kwan Yu, Austin, Tex.

[73] Assignee: Motorola, Inc., Schaumburg, Ill.

[21] Appl. No.: 373,804

[22] Filed: Jan. 17, 1995

Related U.S. Application Data

[63] Continuation-in-part of Ser. No. 143,020, Sep. 29, 1993, Pat. No. 5,399,234.

[51] Int. Cl.[6] ..... H01L 21/306; H01L 21/304; B08B 3/12; B08B 5/02

[52] U.S. Cl. ..... 156/636.1; 134/1; 134/21; 216/88; 216/89

[58] Field of Search ..... 156/636; 134/21, 134/1; 437/228; 216/288, 289

[56] References Cited

U.S. PATENT DOCUMENTS

| | | | |
|---|---|---|---|
| 3,089,790 | 5/1963 | Balamuth et al. | 134/21 |
| 3,915,739 | 10/1975 | Maahs et al. | 134/21 |
| 4,414,244 | 11/1983 | Timberlake et al. | 427/105 |
| 4,680,893 | 7/1987 | Cronkhite et al. | 51/5 R |
| 4,956,024 | 9/1990 | Dean et al. | 134/37 |
| 5,240,552 | 8/1993 | Yu et al. | 156/636 |
| 5,245,796 | 9/1993 | Miller et al. | 51/283 R |
| 5,320,706 | 7/1994 | Blackwell | 156/636 |
| 5,330,577 | 7/1994 | Maeda et al. | 118/722 |
| 5,399,234 | 3/1995 | Yu et al. | 156/636 |

FOREIGN PATENT DOCUMENTS

| | | | |
|---|---|---|---|
| 0226931 | 1/1987 | European Pat. Off. | H01L 21/302 |
| 63-185556 | 1/1987 | Japan | B24B 1/04 |
| 04-135173 | 9/1990 | Japan | B24B 53/00 |

*Primary Examiner*—Robert Kunemund
*Assistant Examiner*—Matthew L. Whipple
*Attorney, Agent, or Firm*—Jasper W. Dockrey

[57] ABSTRACT

A chemical-mechanical-polishing process in which energy is imparted to a polishing pad (18) dislodging particles (46), which are removed by vacuum withdrawal to continuously clean the surface of the polishing pad (14). Energy is imparted to polishing pad (18) by either sonic energy from acoustic waves, or by physical impaction. The acoustic waves are generated by submerging a transducer (28) in the polishing slurry (18). The transducer (28) is powered by a voltage amplifier (30) coupled to a computer controlled-frequency generator (32). The acoustic wave frequency is adjusted by the frequency generator (32) to induce sonic vibration in the polishing pad (14) such that particles (46) are continuously dislodged from polishing pad (14). Physical impaction is performed by an impaction tool (48) coupled to a vacuum head (33).

12 Claims, 3 Drawing Sheets

CHEMICAL-MECHANICAL-POLISHING PAD CLEANING PROCESS FOR USE DURING THE FABRICATION OF SEMICONDUCTOR DEVICES

This is a continuation-in-part of application Ser. No. 08/143,020, now U.S. Pat. No. 5,399,234, filed Sep. 29, 1993.

FIELD OF THE INVENTION

This invention relates in general to a method for fabricating a semiconductor device, and more particularly, to a method for polish planarizing a material layer in a semiconductor device using a chemical-mechanical-polishing apparatus.

BACKGROUND OF THE INVENTION

The increasing need to form planar surfaces in semiconductor device fabrication has led to the development of process technology known as chemical-mechanical-polishing (CMP). In the CMP process, semiconductor substrates are rotated against a polishing pad in the presence of an abrasive slurry. Most commonly, the layer to be planarized is an electrically insulating layer overlying active circuit devices. As the substrate is rotated against the polishing pad, the abrasive force polishes away the surface of the insulating layer. Additionally, chemical compounds within the slurry undergo a chemical reaction with the components of the insulating layer to enhance the rate of removal. By carefully selecting the chemical components of the slurry, the polishing process can be made more selective to one type of material than another. For example, in the presence of potassium hydroxide, silicon dioxide is removed at a faster rate than boron nitride. The ability to control the selectivity of a CMP process has led to its increased use in the fabrication of complex integrated circuits.

A common requirement of all CMP processes is that the substrate be uniformly polished. In the case of polishing a electrically insulating layer, it is desirable to polish the layer uniformly from edge to edge on the substrate. To ensure that a planar surface is obtained, the electrically insulating layer must be uniformly removed. Uniform polishing can be difficult because, typically, there is a strong dependence of the polish removal rate on localized variations in the surface topography of the substrate. For example, in substrate areas having a high degree of surface variation, such as areas having closely spaced active devices, the polishing rate is higher than in areas lacking a high degree of surface contrast. Additionally, the polishing rate at the center of substrate may differ from the polishing rate at the edge of the substrate.

To compensate for the varying removal rates at different locations on the substrate surface, the polishing process is extended to ensure that a planar surface is obtained. A hard, thin-film, referred to as a polish-stop layer, can be used to prevent the unwanted removal of material in the underlying device layers during extended polishing. If the polish-stop material is sufficiently resistant to abrasive removal, and the polishing slurry is selective to the polish-stop material, the polishing time can be extended until the passivation layer is uniformly polished, without damaging underlying layers. To be selective to the polish-stop layer, the chemical components in the slurry must be substantially unreactive with the polish-stop material. Common polish-stop materials include silicon nitride and boron nitride, and the like. In the absence of a polish-stop layer, over-polishing can occur resulting in unwanted removal of underlying layers.

To ensure that uniform polishing action is obtained, it is important that the rate of material removal remain constant. Changes in the surface texture of the polishing pad during the polishing process reduce the degree of abrasiveness of the polishing pad. In particular, during the polishing of an insulating material, such as silicon dioxide, reaction products generated in the polishing slurry, and other debris, collect on the surface of the polishing pad. The collected material fills micropores in the surface of the polishing pad, which is known as glazing. When the micropores become filled with residue from the polishing process, the polishing rate declines. In extreme cases, a decline in polish removal rate can result in an incomplete removal of material leading to a degradation in polishing uniformity. This is because the polishing process is controlled by specifying a time interval for completion of the polishing process. The time interval is calculated based upon a specific and constant polish removal rate.

In order to avoid degradation in the polish removal rate caused by glazing the surface of the polishing pad, the pad is abraded by a conditioner, such as a steel brush. In the abrasion process, material is removed from the surface of the pad by a mechanical grinding process. This process results in removing material from the pad itself in addition to reaction products and debris from the polishing process. Changes in the surface structure of the polishing pad can result in process instability and reduced usable lifetime of the polishing pad.

While CMP potentially offers wide versatility, and the ability to form surfaces with a high degree of planarity, the polishing process must be carefully controlled to maintain optimum process performance. To date, methods to improve processing performance have included the development of high selectivity polishing slurries, and the development of various materials for use as polish-stop layers. However, further development is necessary to provide process parameter stability.

SUMMARY OF THE INVENTION

In practicing the present invention there is provided an improved polishing process for the fabrication of semiconductor devices. A chemical-mechanical-polishing process used to form a planarized layer in semiconductor devices is carried out in which the polishing pad is continuously cleaned by imparting energy to the polishing pad, and applying vacuum withdrawal to remove polishing debris dislodged from the polishing pad. The invention can be practiced either during device processing, or independently in a separate cleaning step. In one embodiment, a polishing apparatus is provided, which includes a polishing pad submerged in a liquid. A dislodging force is applied to the polishing pad and polishing debris dislodged by the applied force are removed by vacuum withdrawal.

Figure 1:
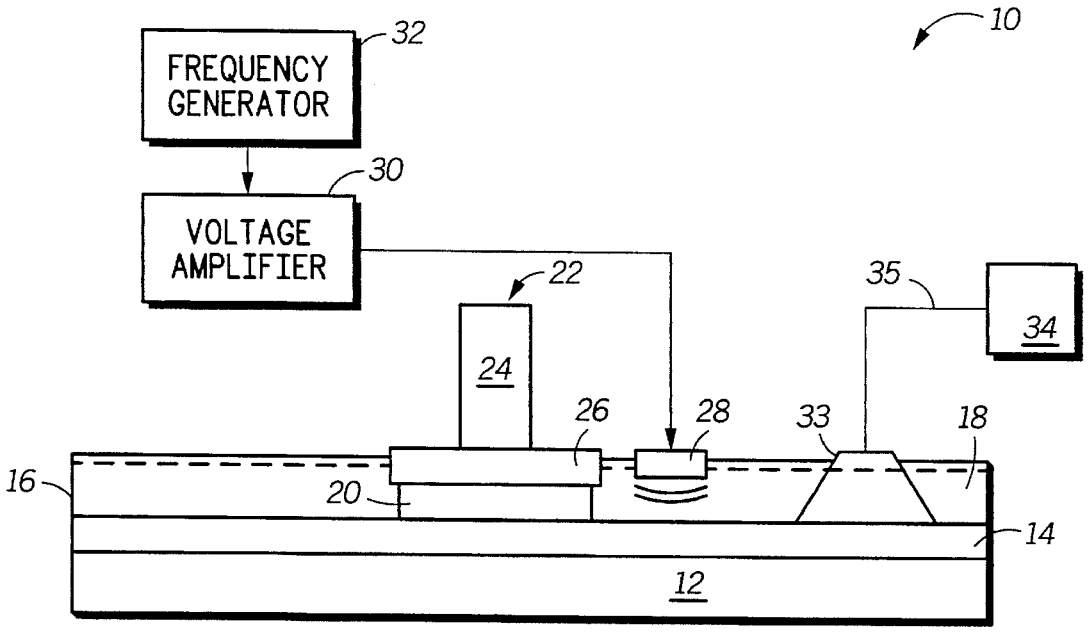
FIG. 1 is a schematic diagram of a polishing apparatus arranged in accordance with one embodiment of the invention.

It will be appreciated that for simplicity and clarity of illustration, elements shown in the Figures have not necessarily been drawn to scale. For example, the dimensions of some of the elements are exaggerated relative to each other for clarity. Further, where considered appropriate, reference numerals have been repeated among the Figures to indicate corresponding elements.

DETAILED DESCRIPTION OF PREFERRED EMBODIMENTS

The present invention provides an improved chemical-mechanical-polishing process for fabrication of semiconductor devices. In one embodiment, acoustic waves are generated within a polishing slurry, while polishing the surface of a semiconductor substrate. The generation of acoustic waves in the slurry provides a means of cleaning the surface of a polishing pad during the polishing process. The acoustic waves provide a constant agitation in the slurry, which prevents the clogging of micropores in the polishing pad by polishing debris suspended in the slurry. The polishing debris dislodged by the acoustic waves are removed from the surface of the polishing pad by vacuum withdrawal. In another embodiment, an impaction force is applied to the polishing pad by an indenter attached to a vacuum head. The indenter imparts sufficient energy to the pad to dislodge polishing debris. The debris are removed by vacuum withdrawal through the vacuum head. The continuous removal of polishing debris from the polishing pad assists in maintaining a constant polishing rate during the polishing process.

Shown in FIG. 1 is a schematic diagram of a polishing apparatus 10 arranged in accordance with the invention. Polishing apparatus 10 includes a polishing platen 12 which supports a polishing pad 14. Both polishing platen 12 and polishing pad 14 are bounded by a slurry retaining wall 16. Polishing pad 14 is submerged in a polishing slurry 18, which is confined to the area of the pad by retaining wall 16. A semiconductor substrate 20, which is to be planarized, is held against polishing pad 14 by a substrate carrier 22. Substrate carrier 22 includes a movable support arm 24 for bringing substrate 20 into contact with polishing pad 14, and a substrate support 26. Substrate support 26 includes a carrier holder and an elastomeric pad (not shown) for holding substrate 20. Those skilled in the art will recognize the previously described features as those of a conventional polishing tool.

In operation, substrate 20 is polished by an abrasive action created by the rotational action of polishing pad 14 and substrate 20. Polishing slurry 18 is a colloidal composition containing an abrasive, such as silica particles, suspended in a solution of potassium hydroxide (KOH) and water. Additional chemicals are sometimes added to the slurry to adjust the pH, and to aid in suspending abrasives. During polishing, polishing slurry 18 serves to lubricate the surface of polishing pad 14, and to create an abrasive action at the surface of substrate 20. In addition, the chemicals in the slurry undergo a chemical reaction at the substrate surface, which assists in removing layers of material from the substrate.

Figure 2:
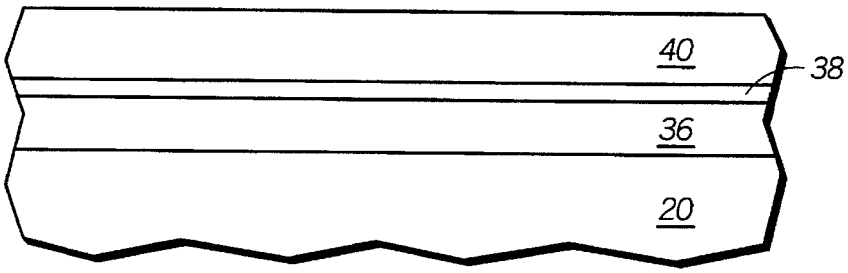
FIG. 2 illustrates, in cross-section, a portion of a semiconductor substrate having a material layer to be polished.

Shown in FIG. 2, in cross-section, is a portion of semiconductor substrate 20 supporting representative material layers commonly used to fabricate semiconductor devices, such as integrated circuits, and the like. In the exemplary structure, an active device layer 36 overlies semiconductor substrate 20. Active device layer 36 contains various components commonly present in a semiconductor device, such as transistors, resistors, capacitors, and the like. The components are fabricated in active regions which are electrically isolated by field isolation regions. Typically, the components are comprised of patterned layers of semiconductor and refractory metal materials. The components are covered by an insulating material to electrically isolate the components from overlying layers of conductive material. Contact openings are present in the insulating layer to permit electrical contact by overlying interconnect leads. The interconnect leads are typically fabricated in one or more overlying metal interconnect layers.

A metal interconnect layer 38 is shown in FIG. 2 overlying active device layer 36. Metal interconnect layer 38 is covered by an insulation layer 40. Although the exact material compositions can vary, in many integrated circuits layer 40 is an insulating material, such as silicon dioxide, silicon nitride, silicate glass, and the like. Metal interconnect layer 38 is typically an electrically conductive metal, such as aluminum alloyed with silicon, or aluminum alloyed with silicon and copper. Alternatively, interconnect layer 38 can be a refractory metal such as tungsten, titanium tungsten, and other refractory metal alloys.

Figure 3:
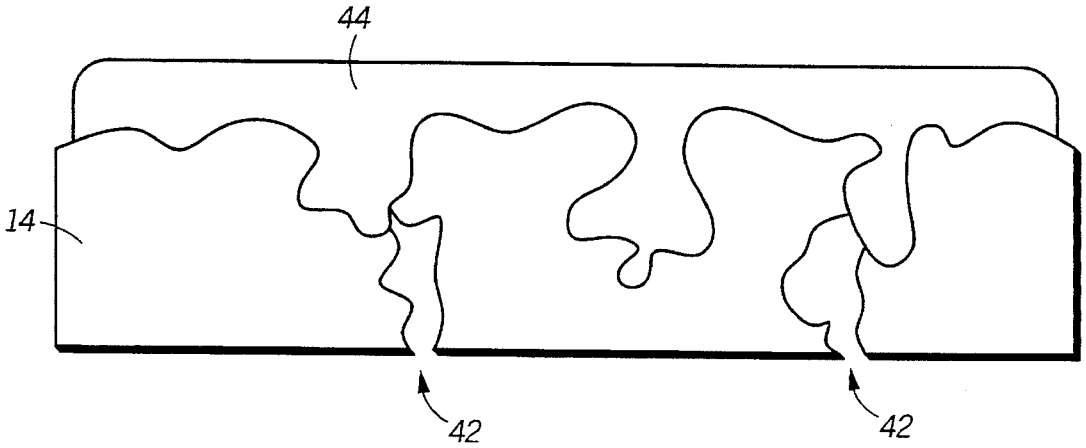
FIG. 3 illustrates, in cross-section, a portion of a polishing pad.

In a polish planarization process, for example, insulation layer 40 is polished by the abrasive action of the polishing pad 14 and polishing slurry 18. Shown in FIG. 3, in cross-section, is a portion of polishing pad 14. Polishing pad 14 is constructed of an open-pore polyurethane material. Micropores 42 are interspersed throughout the polyurethane material of polishing pad 14. During the polishing process, chemical reaction products and abrasives in the slurry accumulate and form a solid layer of polishing debris 44 on the surface of polishing pad 14. This phenomenon is known as "glazing." Glazing of the polishing pad reduces the polishing rate because the mass transfer rate of the polishing slurry is reduced. The transport of polishing slurry 18 between micropores 42 is essential in maintaining a flow of abrasives and reaction products to and from the surface of substrate 20. When micropores 42 become clogged by particles from polishing debris layer 44, the reduced mass transfer rate creates process instability and a general reduction in polishing rate.

To overcome the instability caused by glazing of the polishing pad, in one embodiment of the inventive process, a transducer 28 is submerged in polishing slurry 18. Transducer 28 is powered by a voltage amplifier 30, which amplifies an AC electrical voltage signal from a computer-controlled frequency generator 32. Voltage amplifier 30 is capable of providing 100–500 Watts of AC power to transducer 28. Frequency generator 32 is capable of modulating the electrical voltage signal at transducer 28 in the range of 100 Hz to 1 MHz. When power is applied to transducer 28, acoustic waves are induced in polishing slurry 18. Transducer 28 can be a piezoelectric material such as metallized quartz, or a metallized titanate material, such as lead zirconium titanate, and the like. Transducer 28 is submerged in polishing slurry 18 to enhance the coupling efficiency of the acoustic waves at the transducer to the slurry. The acoustic waves permeate throughout polishing slurry 18 and have an amplitude proportional to the power applied to transducer 28. A resonant vibrational frequency is induced in polishing slurry 18, which dislodges material from the surface of polishing pad 14.

A vacuum head 33 rides on the surface of polishing pad 14, as illustrated in FIG. 1. Vacuum head 33 is coupled to a vacuum pumping system 34 by a vacuum line 35. Vacuum head 33 is either completely or partially submerged in polishing slurry 18. Liquid polishing slurry and polishing debris are drawn through vacuum head 33 by vacuum pressure created by vacuum system 34. In an optional method of the invention, the polishing debris is filtered out of the polishing slurry and the filtered slurry is returned to polishing apparatus 10 by mean of a slurry return line (not shown).

Figure 4:
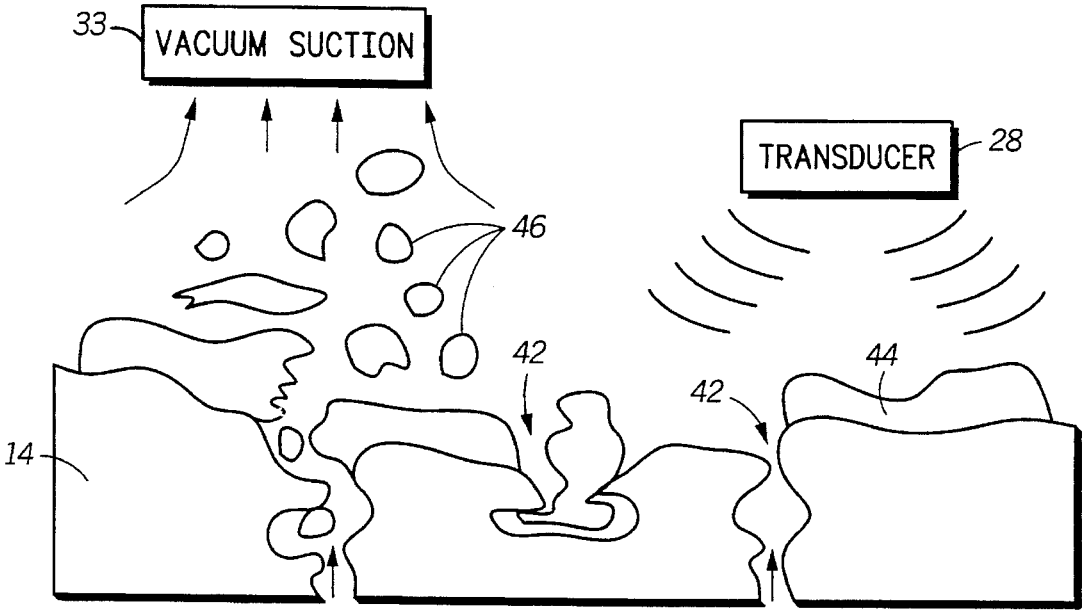
FIG. 4 illustrates, in cross-section, the removal of polishing debris in accordance with the invention.

FIG. 4 illustrates, in cross-section, a portion of polishing pad 14 undergoing a cleaning process in accordance with one embodiment of the invention. Transducer 28 imparts acoustical energy to polish pad 14, which dislodges particles 46 from micropores 42. Once the particles are dislodged, they are drawn into vacuum head 33 by vacuum pressure generated by vacuum system 34. Transducer 28 imparts sufficient energy to polishing pad 14 such that a vibrational motion is created in polishing pad 14. The vibrational motion is of sufficient energy to break up slurry debris layer 14, and to dislodge particles trapped in micropores 42.

In an alternative method, water is forced through micropores 42 of polishing pad 14. The use of water to clean polishing pad 14 requires that polishing apparatus 10 be taken off-line and a special cleaning process carried out. Polishing slurry 18 is drained away, and a small amount of water is applied to the surface of polishing pad 14. The cleaning can be performed by either rotating polishing platen 12 while holding vacuum head 33 stationary, or alternatively, by drawing vacuum head 33 is across the surface of polishing pad 14.

Figure 5:
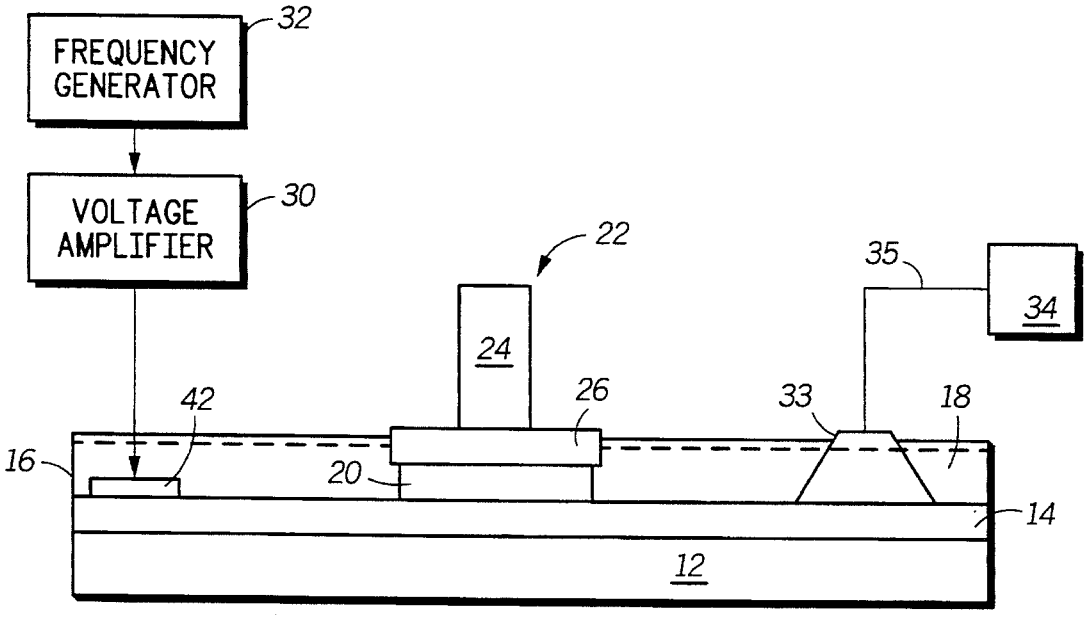
FIG. 5 is a schematic diagram of a polishing apparatus arranged in accordance with another embodiment of the invention.

Another embodiment of the invention is illustrated in the schematic diagram shown in FIG. 5. In this embodiment, voltage amplifier 30 powers a piezoelectric transducer 47, which is in contact with polishing pad 14. In operation, an acoustic wave is transmitted to polishing pad 14 from transducer 47 at a frequency ranging from about 100 Hz to 1 MHz. The acoustic waves impart vibrational energy to polishing pad 14. The vibration continuously breaks up solid residue on the surface of polishing pad 14, thereby improving the efficiency of the polishing process. The abrasiveness of polishing pad 14 is maintained at a high level by continuously removing reaction products and polishing debris from the surface of polishing pad 14. Additionally, by continuously cleaning the surface of pad 14, polishing apparatus 10 does not have to be shut down or otherwise interrupted for either a manual cleaning of the polishing pad, or for performing a process cleaning cycle. The continuous cleaning of the polishing pad results in longer periods of operation with shorter periods of down-time for cleaning maintenance. Thus, the continuous removal of material from the surface of polishing pad 14 results in maintaining a high polishing rate, and longer hours of continuous operation.

In order to optimize the acoustic energy transmitted to polishing pad 14, computer-controlled frequency generator 32 modulates the input signal to transducer 47 at the resonant frequency of polishing slurry 18 and polishing pad 14. For example, a sustained vibration can be induced in the polishing pad and the slurry by generating an acoustic wave having a frequency of preferably about 1 kHz at about 100 to 500 Watts. By transmitting acoustic waves at the resonant frequency of the slurry and the pad, maximum vibrational energy is achieved. Of course, the acoustic wave frequency must be varied depending upon the physical dimensions and composition of the polishing pad and the underlying platen. For example, in a polishing system having a platen diameter of one meter, the operational range of the transducer is preferably about 1 to 5 kHz.

Figure 6:
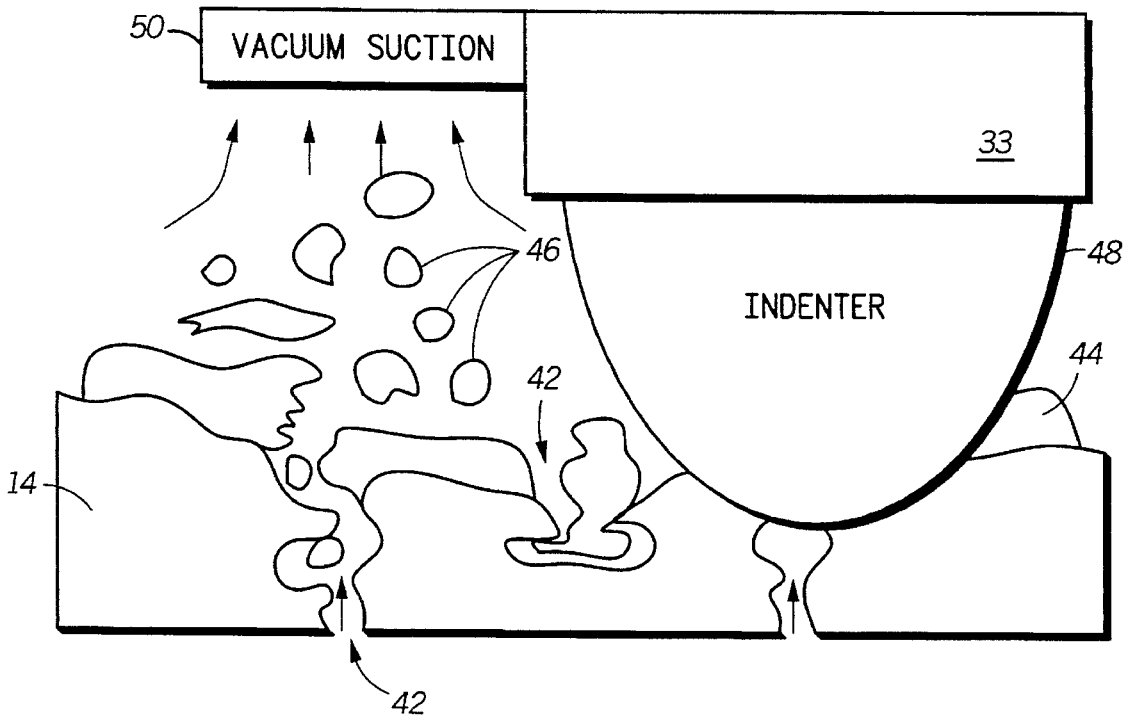
FIG. 6 illustrates, in cross-section, the removal of polishing debris in accordance with yet another embodiment of the invention.

FIG. 6 illustrates, in cross-section, a portion of polishing pad 14 undergoing a cleaning process in accordance with yet another embodiment of the invention. In the alternative embodiment, particles 46 are dislodged from micropores 42 and from the surface of polishing pad 14 by means of mechanical deformation. Means for mechanically deforming polishing pad 14 are contained within vacuum head 33. As vacuum head 33 moves across the surface of polishing pad 14, as shown by the directional arrow in FIG. 6, the surface of polishing pad 14 is mechanically deformed. An indenter 48 protrudes from vacuum head 33 and makes physical contact with the surface of polishing pad 14, and with polished debris layer 44. A vacuum section 50 of vacuum head 33 creates a low pressure region, which draws particles 46 away from polishing pad 14 and into vacuum section 50.

Damage to polishing pad 14 is avoided because the rounded surface of indenter 48 prevents any physical damage to the polished pad material. Although illustrated in FIG. 6 as a blunt object, indenter 48 can be formed by a variety of different mechanical devices. In the embodiment of the invention illustrated in FIG. 6, the cleaning process can be carried out by any impaction means capable of resenting a physical impaction force to polishing pad 14.

The cleaning process of the present invention avoids deleterious effects to the polishing pad by continuously blowing liquid through the micropores of the polishing pad. Both the acoustic vibrational technique and the physical impaction technique will not alter the surface roughness of polishing pad 14.

In a further embodiment, the dislodging force is exclusively provided by the vacuum pressure generated at vacuum head 33. The vacuum pressure is adjusted to a level sufficient to dislodge slurry debris from the surface of polishing pad 14 without the assistance of another energy source. The vacuum process provides a simplified, low cost cleaning process with minimal physical contact with the polishing pad. As in the other embodiments, the vacuum pressure method can be carried out either during wafer polishing, or in a separate off-line cleaning step.

Thus it is apparent that there has been provided, in accordance with the invention, an acoustically regulated polishing process which fully meets the advantages set forth above. By maintaining consistent surface texture of polishing pad 14, improved polishing process stability is obtained. Although the invention has been described and illustrated with reference to specific illustrative embodiments thereof, it is not intended that the invention be limited to those illustrative embodiments. Those skilled in the art will recognize that variations and modifications can be made without departing from the spirit of the invention. For example, many different styles of vacuum systems can be used, including several different kinds of commonly available liquid vacuum pumps. Furthermore, vacuum throttling mechanisms can be used to vary the vacuum pressure applied at the surface of the polishing pad. It is therefore intended to include within the invention all such variations and modifications as fall within the scope of the appended claims and equivalents thereof.

We claim:

1. A chemical-mechanical-polishing process for fabricating a semiconductor device comprising the steps of:

providing a polishing apparatus having a polishing pad submerged in a liquid;

imparting a dislodging force to the polishing pad; and removing polishing debris from the polishing pad by vacuum withdrawal.

2. The process of claim 1, wherein the step of imparting a dislodging force comprises generating acoustic waves.

3. The process of claim 1, wherein the step of imparting a dislodging force comprises physical impaction of the polishing pad.

4. The process of claim 1, wherein the step of providing a liquid comprises providing a liquid selected from the group consisting of a polishing slurry and water.

5. The process of claim 1 further comprising submerging a semiconductor substrate in the liquid.

6. A chemical-mechanical-polishing process for fabricating a semiconductor device comprising the steps of:

providing a polishing pad submerged in a polishing slurry for the removal of a material layer from a semiconductor substrate;

submerging a semiconductor substrate in the polishing slurry;

imparting energy to the polishing pad to dislodge polishing debris from the polishing pad; and removing the polishing debris from the polishing pad by vacuum withdrawal.

7. The process of claim 6, wherein the step of imparting energy comprises imparting acoustic energy.

8. The process of claim 6, wherein the step of imparting energy comprises physical impaction of the polishing pad with a blunt object.

9. The process of claim 8, wherein the blunt object comprises a member protruding from a vacuum device.

10. A chemical-mechanical-polishing process for fabricating a semiconductor device comprising the steps of:

providing a polishing apparatus having a polishing pad submerged in a polishing slurry;

submerging a semiconductor substrate in the polishing slurry, the substrate having a surface;

polishing the surface with the polishing pad to remove material from the surface;

generating acoustic waves in the polishing slurry, wherein the acoustic waves continuously dislodge material from the polishing pad; and removing dislodged material from the polishing pad by vacuum withdrawal.

11. The process of claim 10, wherein the step of generating acoustic waves comprises submerging an acoustic transducer in the polishing slurry and applying electrical power to the transducer.

12. The process of claim 10, wherein the step of generating acoustic waves comprises placing acoustic transducer in contact with the polishing pad and inducing acoustic vibration within the polishing pad.

* * * * *